US010010203B1

(12) United States Patent
Vaughn

(10) Patent No.: US 10,010,203 B1
(45) Date of Patent: Jul. 3, 2018

(54) MECHANICAL BEVERAGE COASTER WITH INSERT AND A MEANS TO EMPTY EXCESS MOISTURE

(71) Applicant: William Harley Vaughn, Huntsville, TX (US)

(72) Inventor: William Harley Vaughn, Huntsville, TX (US)

( * ) Notice: Subject to any disclaimer, the term of this patent is extended or adjusted under 35 U.S.C. 154(b) by 0 days.

(21) Appl. No.: 15/001,105

(22) Filed: Jan. 19, 2016

(51) Int. Cl.
*A47G 23/03* (2006.01)

(52) U.S. Cl.
CPC ..... *A47G 23/03* (2013.01)

(58) Field of Classification Search
CPC ..... A47G 23/03; A47G 19/2283
See application file for complete search history.

(56) References Cited

U.S. PATENT DOCUMENTS 2,496,157 A * 1/1950 Gaudino ..... A47G 23/03 248/346.11
3,257,092 A * 6/1966 Blundell ..... A47G 23/03 215/394
3,268,198 A * 8/1966 Swett ..... A47G 19/2283 248/346.11
3,363,869 A * 1/1968 Blundell ..... A47G 23/03 215/394
3,797,796 A * 3/1974 Lansdowne ..... A47G 23/03 248/346.11
4,858,872 A * 8/1989 Witt ..... A47G 23/03 248/146
D408,227 S * 4/1999 Swann, Jr. ..... D7/624.1
6,089,519 A * 7/2000 Laybourne ..... A47G 23/03 220/212
6,102,352 A * 8/2000 Kvalvog ..... A47G 23/03 248/346.11
8,376,304 B2 * 2/2013 Almada ..... A47G 23/03 248/346.11
D677,994 S * 3/2013 Williams ..... D7/624.1
D696,077 S * 12/2013 Williams ..... D7/624.1
8,960,626 B1 * 2/2015 Taylor ..... A47G 23/03 248/346.11
D736,567 S * 8/2015 Williams ..... D7/624.1
D738,691 S * 9/2015 Williams ..... D7/624.1
9,380,900 B2 * 7/2016 Tehensky ..... A47G 23/03

* cited by examiner

*Primary Examiner* — Bradley Duckworth
(74) *Attorney, Agent, or Firm* — Wick Phillips Gould & Martin LLP; Jerry C. Harris, Jr.

(57) ABSTRACT

This is a drink coaster which incorporates a mechanical means to expel condensation collected from a cold drink that is supported by the coaster. This coaster compromises an injection molded non fragile plastic top surface with a plurality of drain holes, a highly porous insert in the middle and a base recessed for the insert and extra condensation that may be collected from the beverages. The base snaps into the top surface which allows this coaster to be disassembled for easy cleaning or for the insert to be replaced. This disassembly of the coaster allows a more effective way of cleaning the coaster thoroughly to prevent mold or musty odors with its use. The mechanical portion of the coaster allows pushing upwards from the bottom of coaster which contacts the insert to expel excess condensation out thru the drain holes at the top of the coaster.

9 Claims, 7 Drawing Sheets

MECHANICAL BEVERAGE COASTER WITH INSERT AND A MEANS TO EMPTY EXCESS MOISTURE

FIELD OF THE INVENTION

The present invention relates to the field of beverage coasters

BACKGROUND

It is well known that condensation or moisture collects on the outer surface of cold drinking vessels such as Glasses, running down the vessel and collecting on the surface in which the glass or container is resting upon which could cause damage to that surface. Drink coasters have been used for many years as a means to prevent damage to furniture from that moisture. It is well known that coasters made of cork, paper, cloth, or stoneware lose their effectiveness to protect the surface from damage when they become over saturated. To solve this problem a water absorbing material could be placed in a water proof support. This is the approach taken in U.S. Pat. No. 3,797,796 to Lansdowne Issued in 1974 and U.S. Pat. No. 4,858,873 to Wilmoth Issued in 1989. These coasters didn't have a device for emptying the accumulated moisture. This was solved by U.S. Pat. No. 8,376,304 Issued to Almada in 2013. However, this coaster wasn't able to be dis-assembled for cleaning or replacement of the Insert.

SUMMARY OF THE INVENTION

According to the embodiment of the present invention, a beverage coaster compromising a top surface structured to support a beverage container. The top surface slightly recessed to hold container with a plurality of drain holes and a bottom surface structured with a inner chamber that holds a moisture absorbing insert. The bottom surface can be pushed upward by and user to contact insert to expel excess moisture out thru the drain holes. The top surface also has lock and release tabs for holding the bottom surface in place, this allows for the coaster to be disassembled for cleaning and or replacement of the insert. The top surface also extends past the bottom surface which keeps bottom surface from being in contact with the surface it sits on. These and other aspects, features, and advantages of the present invention will become apparent from the following detailed description of the preferred embodiments, which is to be read in connection with the accompanying drawings.

BRIEF DESCRIPTION OF THE DRAWING

FIG. 1 shows a beverage coaster Illustrated by dotted lines, a drinking glass supported there by.

DETAILED DESCRIPTION

Figure 1:
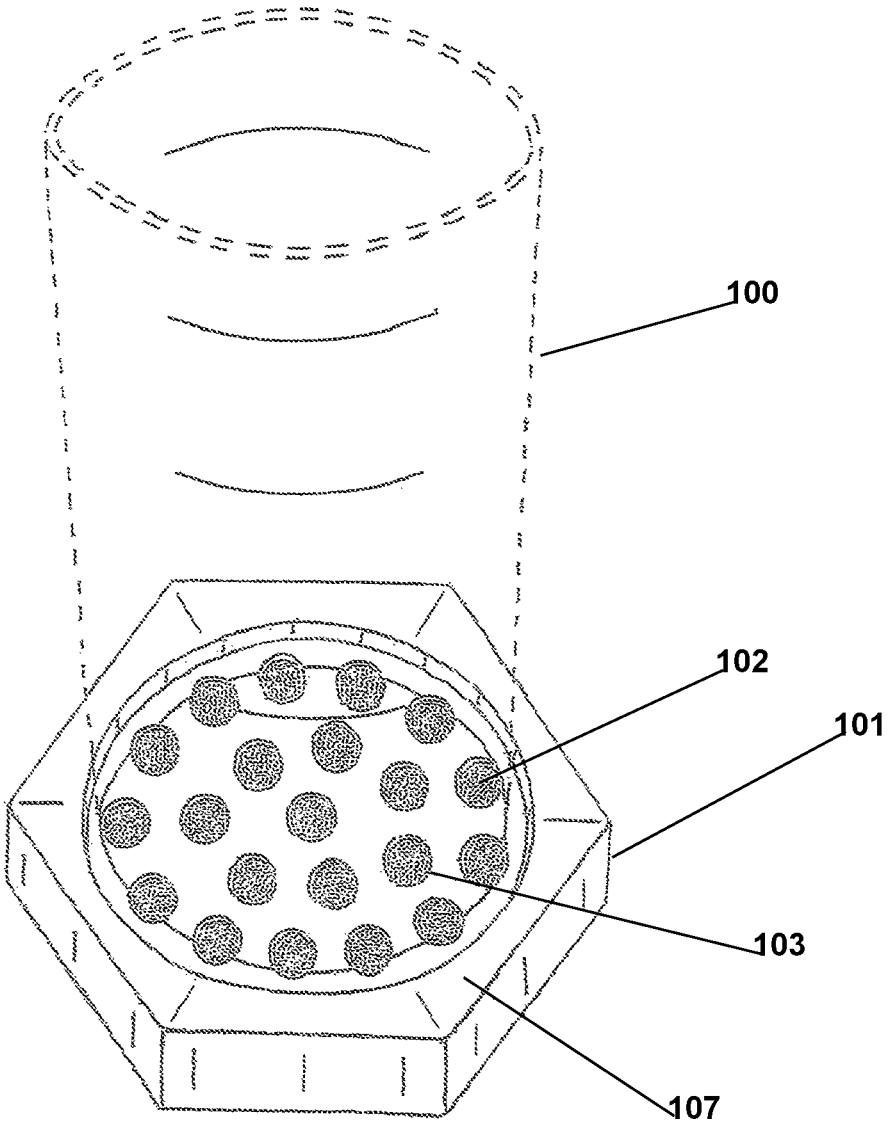

FIG. 1 Illustrates a beverage coaster 101 illustrated by dotted lines a beverage container 100 supported thereby according to the embodiment of the invention showing the beverage coaster 101 includes a top surface in the shape of a hexagon 107 with a plurality of drain holes 103 that allow moisture from the beverage container 100 to pass through and collect in the insert 102.

In various other embodiments, the top surface 107 is made from a durable injection molded plastic that includes other shapes and patterns and is meant for illustration purposes only.

Figure 2A:
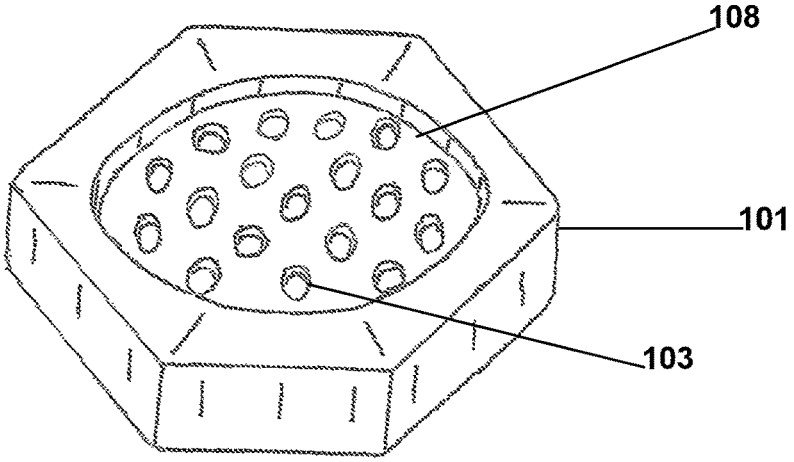
FIG. 2A shows top portion of coaster recessed with a plurality of drain holes.

FIG. 2A illustrates a 3 dimensional view of the top of the beverage coaster 101 with a recess area for the beverage container 108 with a plurality of drain holes 103 that excess moisture flows through.

Figure 2B:
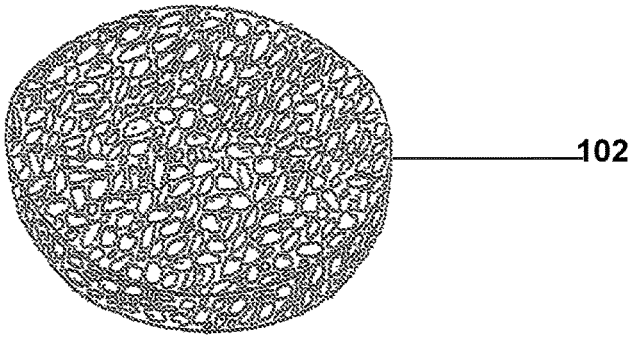
FIG. 2B shows a sponge insert.

FIG. 2B illustrates a 3 dimensional view of the moisture absorbing insert 102. This insert can be of a sponge like material including natural, synthetic, material that will absorb moisture.

Figure 2C:
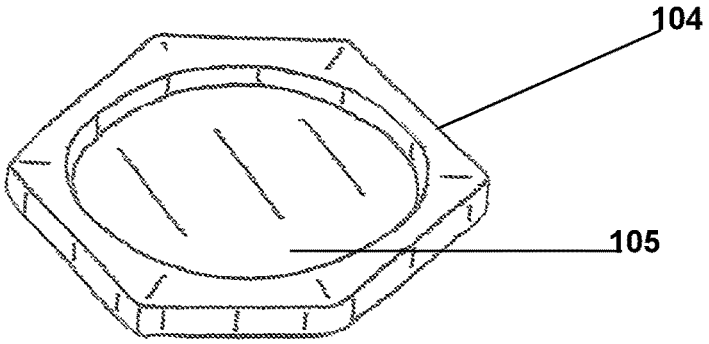
FIG. 2C shows bottom portion of coaster recessed to hold insert and excess moisture.

FIG. 2C illustrates a 3 dimensional view of the bottom surface of the coaster embodiment 104 showing a recessed area 105 for the insert.

Figure 3A:
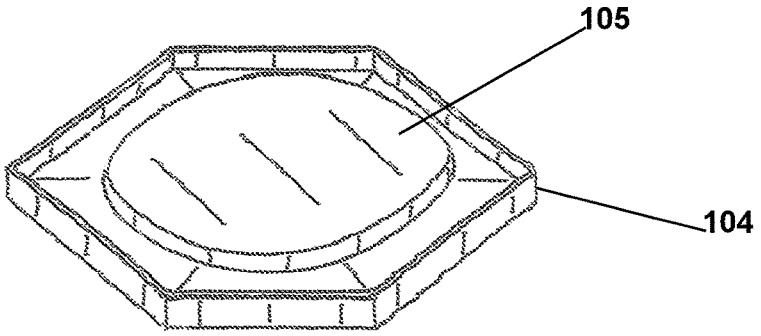
FIG. 3A shows bottom portion of coaster inverted or upside down.

FIG. 3A illustrates a 3 dimensional inverted or upside down view of the bottom of the coaster 104 the recess area 105 is also inverted.

Figure 3B:
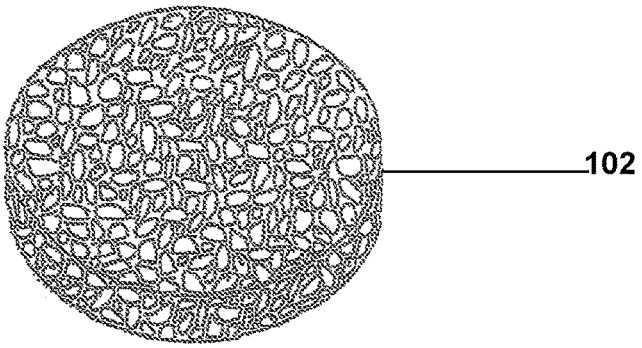
FIG. 3B shows a sponge insert inverted.

FIG. 3B illustrates a 3 dimensional inverted view of the insert 102. This insert is a moisture absorbing layer preferably sponge like.

Figure 3C:
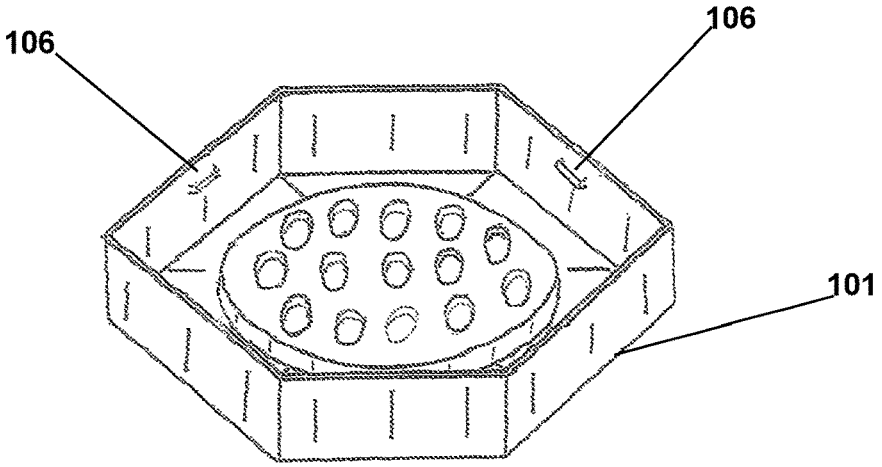
FIG. 3C shows top portion of coaster inverted to reveal lock and release tabs that allow disassembly of coaster embodiment.

FIG. 3C illustrates a 3 dimensional inverted or upside down view of the top of the coaster 101 this view shows the lock and release tabs 106 which hold the 3 pieces of the embodiment together, the lock and release tabs 106 allow for the embodiment of the coaster 101 to be disassembled for easy cleaning or replacement of the insert 102.

Figure 4A:
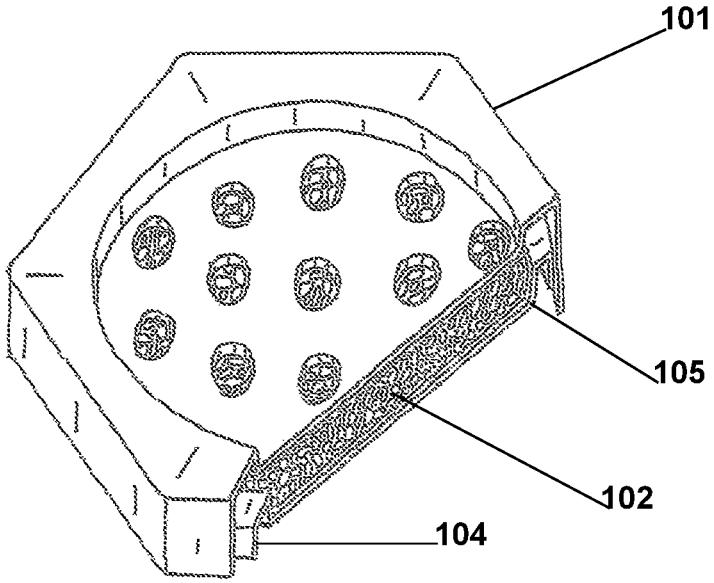
FIG. 4A shows cut away cross section view of coaster before user squeeze the bottom of coaster to contact the insert.

FIG. 4A illustrates a 3 dimensional cut away view of the coaster embodiment 101 which shows a moisture absorbing instant such as a sponge 102 resting in recessed area 105 of the bottom of the coaster embodiment 104 fully relaxed and un-compressed.

Figure 4B:
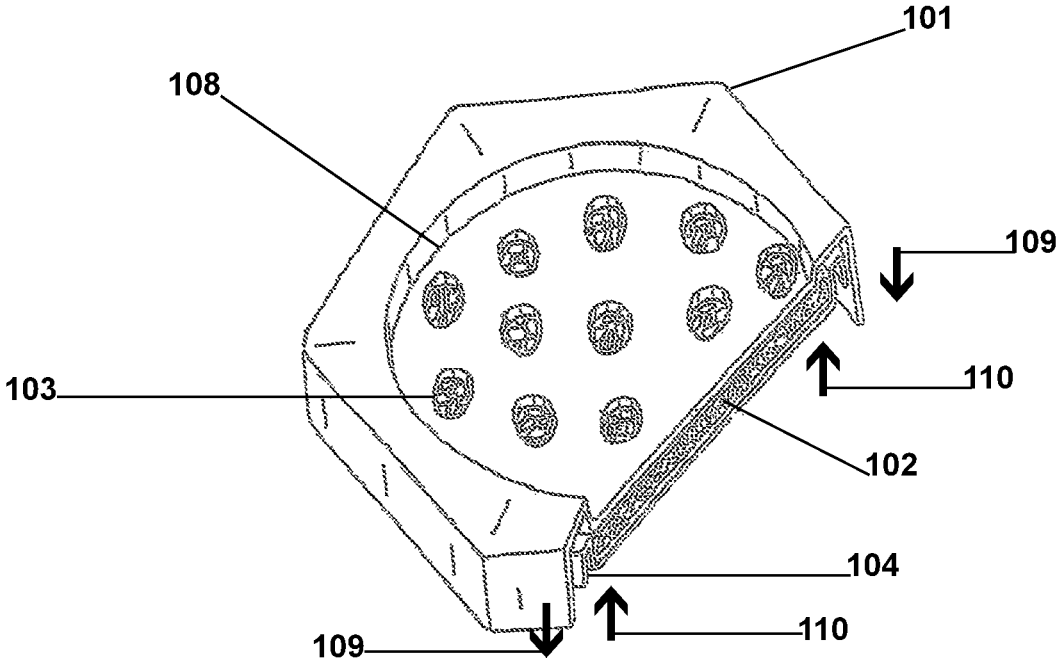
FIG. 4B shows cut away cross section view of coaster after user squeezes bottom of coaster upwards to make contact with insert to expel moisture out of drain holes.

FIG. 4B illustrates 3 dimensional cut away view showing the coaster embodiment 101 with the sponge like insert 102 sitting in the bottom embodiment 104 in a compressed state or a collapsed state after being compressed upwards by an user. The arrows 109 and 110 show the directional movement of bottom of the coaster embodiment 104 to force out any moisture through the holes 103 which is the path of least resistance, the recessed area 108 keeps the drink container from sliding off the coaster embodiment 101.

Figure 5:
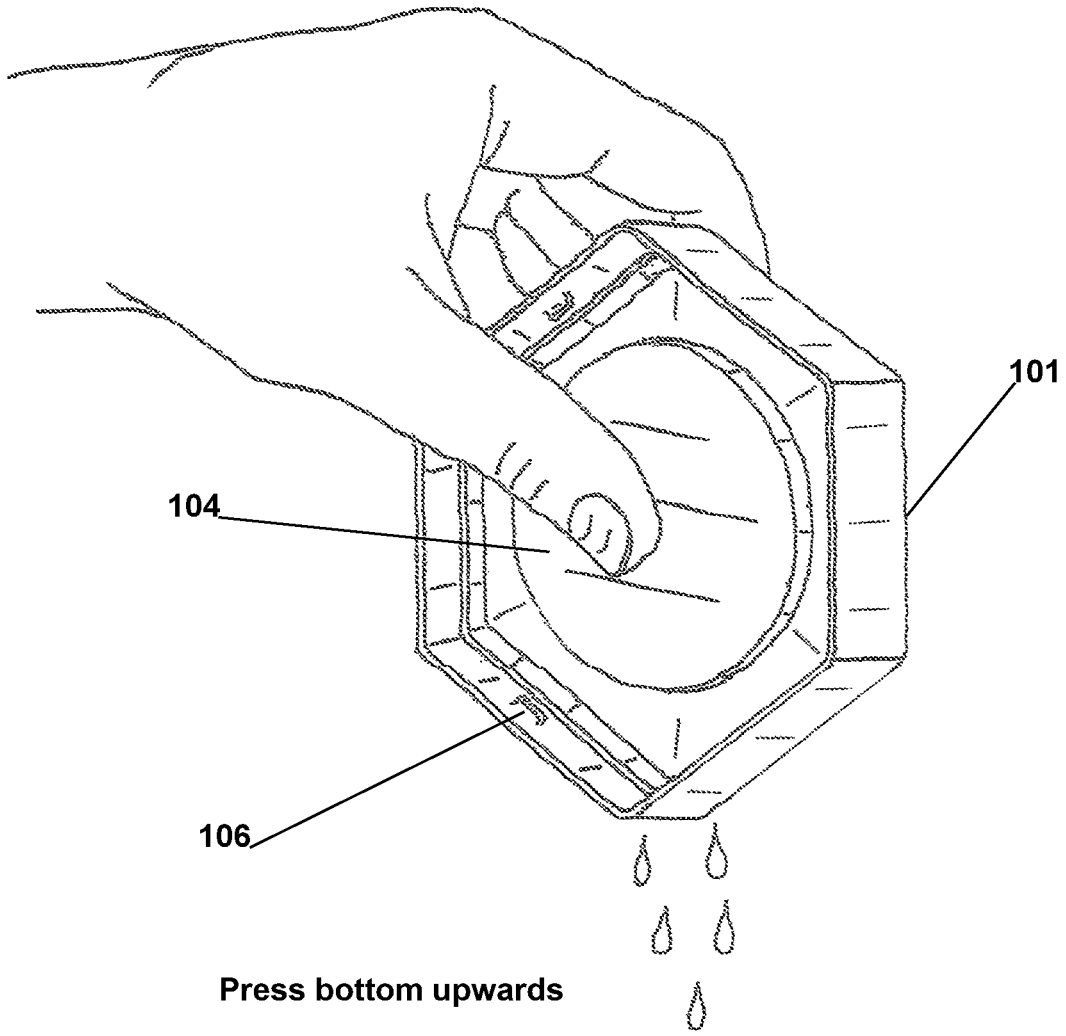
FIG. 5 shows user squeezing bottom of coaster to expel excess moisture.

FIG. 5 illustrates a 3 dimensional view showing a user holding the coaster embodiment 101 pressing the bottom of the coaster embodiment 104 to force out any moisture that has been collected the lock and release tabs 106 hold the coaster embodiment together, these lock and release tabs 106 also allow the coaster 101 to be disassembled for cleaning or replacement of the insert.

Figure 6:
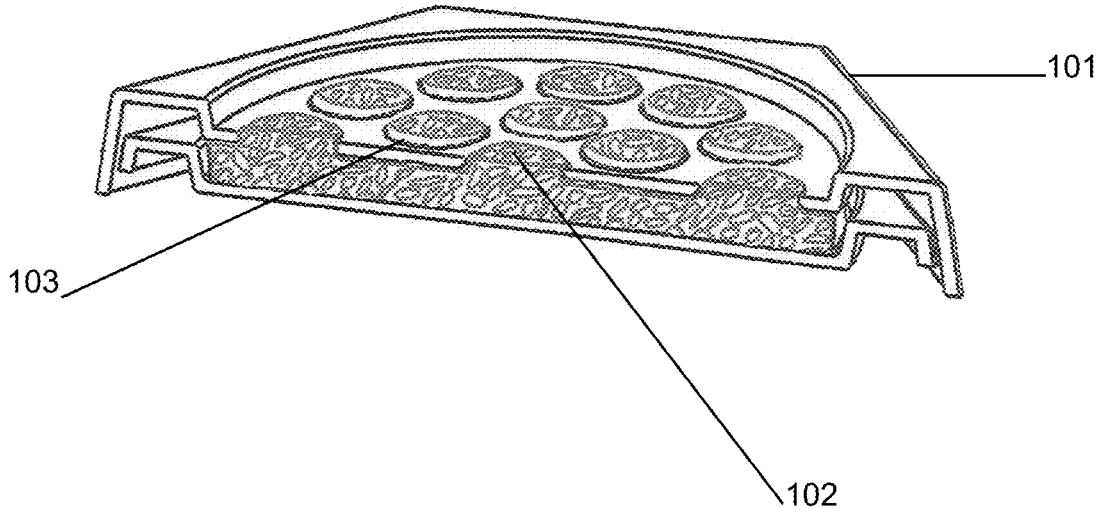
FIG. 6 shows sponge insert protruding slightly thru drain holes.

FIG. 6 Illustrates a 3 dimensional cut away view showing the coaster embodiment 101 with the sponge like insert 102 protruding thru the holes 103 of the coaster embodiment.

Figure 7:
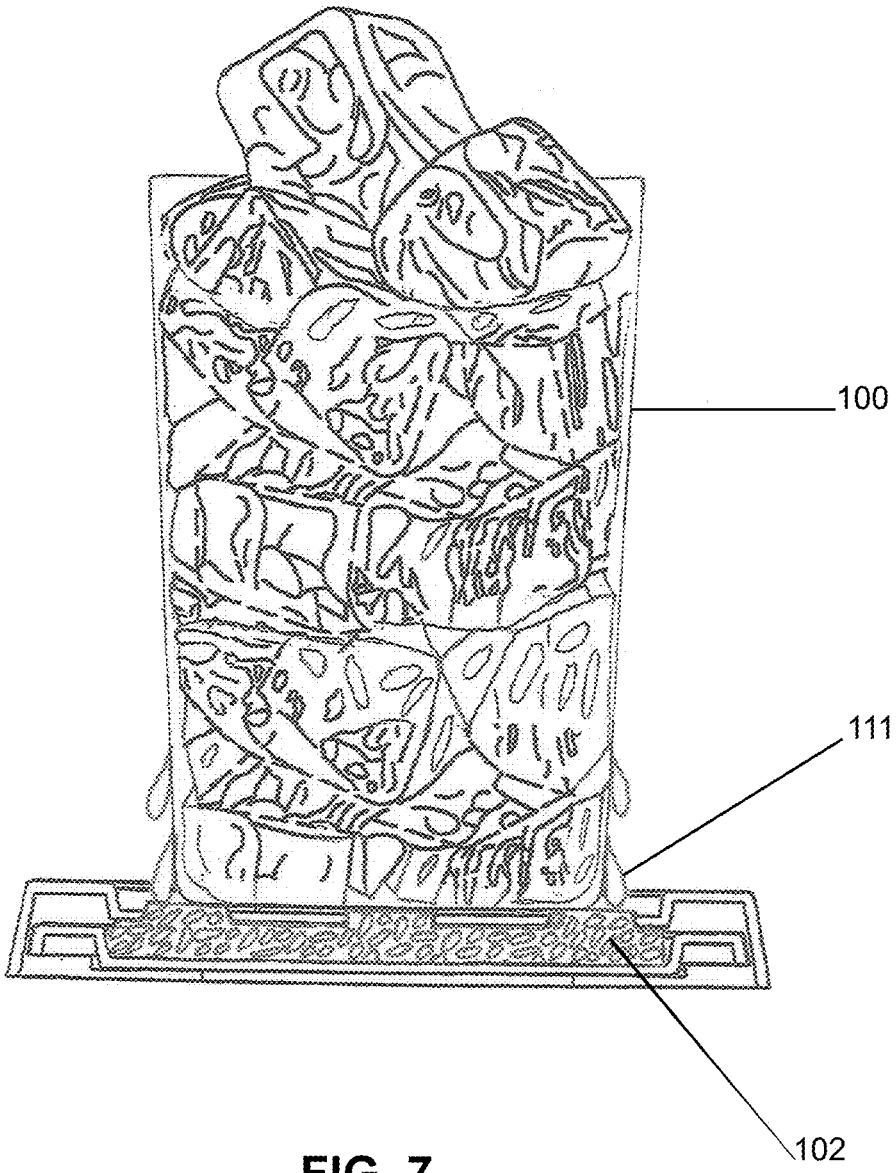
FIG. 7 shows moisture being wicked off beverage container by the protrusion of the sponge insert.

FIG. 7 Illustrates a 3 dimensional cut away view showing the beverage container 100 with condensation 111 being wicked into sponge insert 102.

What is claimed is:

1. A beverage coaster, comprising:

a beverage container supporting component, wherein the beverage container supporting component comprises a plurality of drain holes, wherein the beverage container supporting component contracts a surface upon which the beverage coaster is located;

a pressure sensitive component, wherein the pressure sensitive component comprises a moisture absorbing component placement area, wherein a position of the pressure sensitive component may be altered via an application of force to the pressure sensitive component, and wherein the pressure sensitive component does not contact the surface upon which the beverage coaster is located; and a moisture absorbing component, wherein the moisture absorbing component is located proximate to the moisture absorbing component placement area.

2. The beverage coaster of claim 1, wherein the moisture absorbing component is a sponge.

3. The beverage coaster of claim 1, wherein the beverage container supporting component is recessed to prevent a beverage container from sliding off the beverage coaster.

4. The beverage coaster of claim 1, further comprising;

lock and release tabs, wherein the lock and release tabs are disengageable for complete separation of the beverage container supporting component from the pressure sensitive component.

5. The beverage coaster of claim 4, wherein the moisture absorbing component is removable from a separated beverage container supporting component and pressure sensitive component.

6. The beverage of claim 1, wherein the beverage container supporting component and the pressure sensitive component comprise injection molded plastic.

7. The beverage coaster of claim 1, wherein the moisture absorbing component placement area is configured to collect moisture.

8. The beverage coaster of claim 1, wherein the moisture absorbing component protrudes through the drain holes.

9. The beverage coaster of claim 1, wherein the beverage coaster is configured for stacking of a plurality of beverage coasters.

* * * * *